United States Patent [19]

Wallace et al.

[11] 4,258,472

[45] Mar. 31, 1981

[54] SHEAR

[75] Inventors: Edward M. Wallace, Longmeadow; Robert G. Gosselin, Springfield; Ernest D. Labarre, Holyoke, all of Mass.

[73] Assignee: Wallace Mfg. Corp., Enfield, Conn.

[21] Appl. No.: 78,910

[22] Filed: Sep. 26, 1979

[51] Int. Cl.[3] ..... B26B 13/00

[52] U.S. Cl. ..... 30/262

[58] Field of Search ..... 30/262, 261, 254; 40/10 R, 2

[56] References Cited

U.S. PATENT DOCUMENTS

| | | | |
|---|---|---|---|
| 2,189,211 | 2/1940 | Lind | 30/262 |
| 2,295,385 | 9/1942 | Connors | 30/262 X |
| 2,574,354 | 11/1951 | Smith | 30/262 X |
| 2,715,270 | 8/1955 | Oxhandler | 30/262 |
| 3,121,813 | 2/1964 | Pratt | 40/10 R |
| 3,494,818 | 2/1970 | Marchese | 40/2 R |

*Primary Examiner*—Jimmy C. Peters

*Attorney, Agent, or Firm*—Ross, Ross & Flavin

[57] ABSTRACT

An elongated pressure sensitive adhesive element for attachment within a recess on a component part of a shear, the upper side of the sheet carrying indicia for indicating the manufacturer or distributor or seller of the shear. The shear has pivoted crossed blades normally biased to opened position and is provided preferentially with a recess or inset in the spine or upper wall of the upper handle, into which an ornamental and/or information-bearing label may be inserted: (a) to impart a pleasing appearance to the tool; (b) to conceal an unsightly rivet which attaches the biasing spring to the handle; and (c) to carry information such as the manufacturer's or distributor's name, his trademark, tool model or number, or the like. The label and upper handle may be of contrasting colors to enhance tool attractiveness.

6 Claims, 7 Drawing Figures

SHEAR

This invention is directed to improvements in a shear and more particularly to the provision of an inset or recess in the spine or upper wall of the upper shear handle, into which inset an ornamental and/or information-bearing label may be inserted: (a) to impart a pleasing appearance to the tool; (b) to conceal an unsightly rivet which attaches the biasing spring to the handle; (c) to carry information such as the manufacturer's or distributor's name, his trademark, tool model or number, or the like; and (d) to provide a means whereby the indicia so carried can be easily changed so as to allow a manufacturer to accommodate readily to the individual requirements of a plurality of distributors or retailers.

The label will be preferentially of the pressure sensitive adhesive type for facilitating ready attachment to the upper shear handle, or for that matter to any other area of any other shear component.

The label will be of such design as to provide an ornamental trim strip and may be made of plastic for decoration purposes and may be readily attachable by means of a suitable adhesive composition.

The combination ornamental/information bearing label of the invention allows the application of identifying data to the tool at the end of the production run while providing an attractive, decorative effect to the tool.

Figure 1:
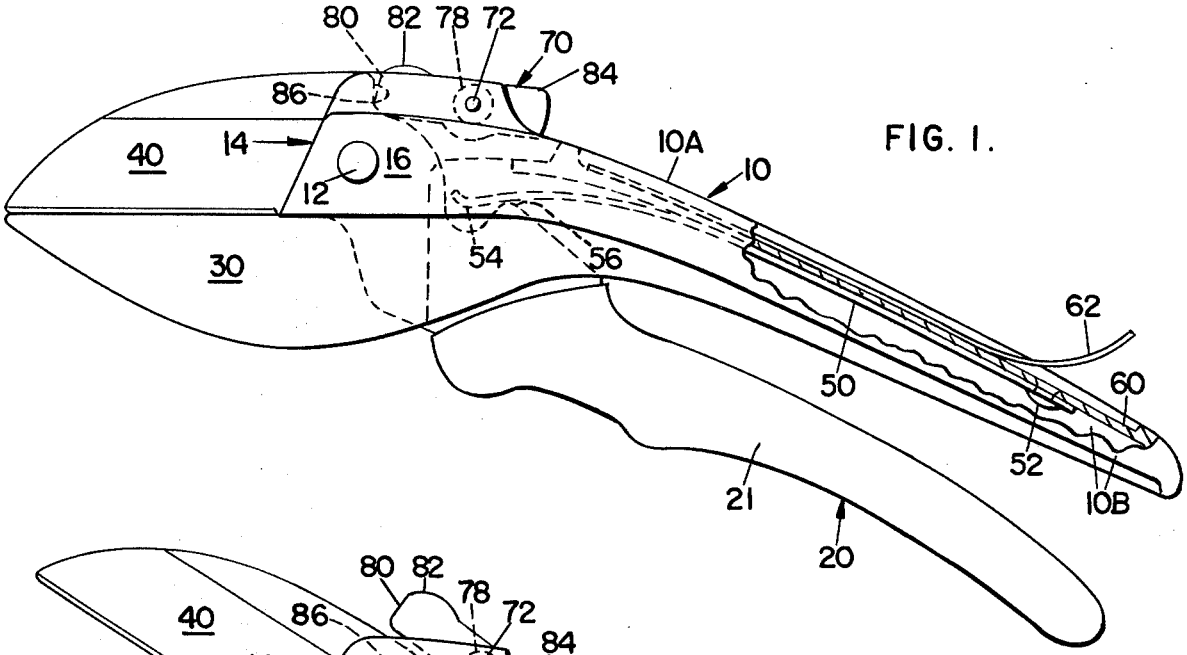
FIG. 1 is a view, in side elevation, of a shear in a shear-closed position and incorporating the invention.
Figure 2:
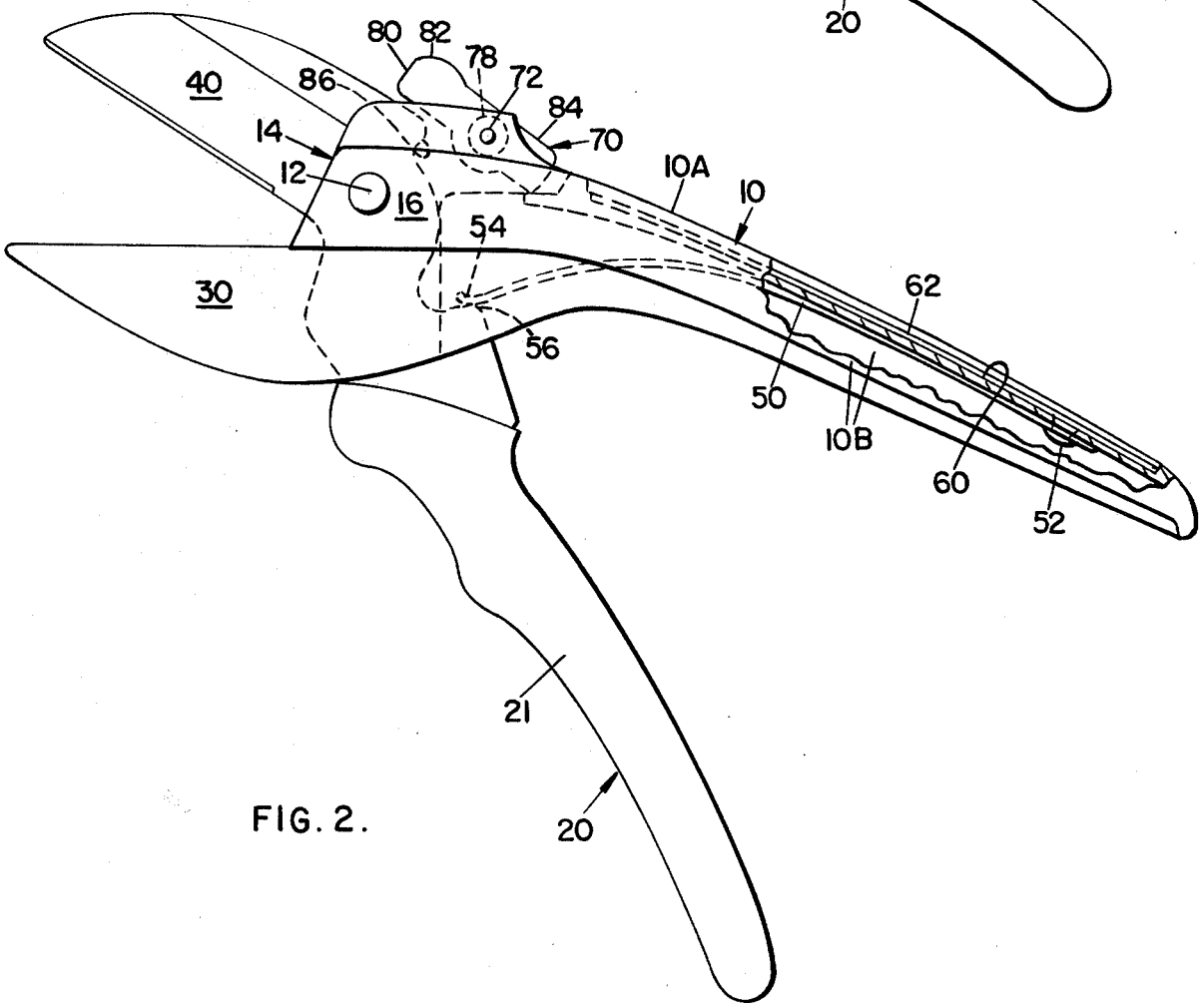
FIG. 2 is a view, in side elevation, of a shear in shear-opened position and incorporating the invention.
Figure 3:
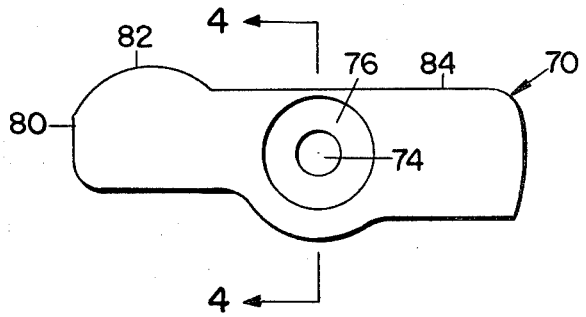
FIG. 3 is a view, on enlarged scale, and in side elevation, of the shear latch means.
Figure 4:
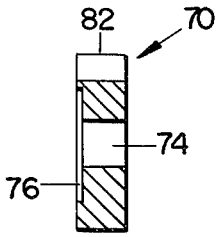
FIG. 4 is a view, in cross section, taken on line 4—4 of FIG. 3.

While many types of shear are contemplated for the employment therewith of this invention, there is illustrated a crossed lever type of tool. It includes an upper handle 10 and a lower handle 20, pivotally jointed as by a pivot 12, the lower handle being covered by the usual rubber or plastic covering 21.

Upper handle 10 is configured to define a spine or top wall 10A and opposite side walls 10B and, at its inboard end, is provided with a yoke 14 between the spaced opposite cheeks 16 of which lower handle 20 is extendable, the yoke cheeks being disposed on opposite sides of a lower hook or anvil blade 30 and an adjacent confronting upper cutting blade 40. Upper cutting blade 40 and lower handle 20 preferentially are unitary.

Lower hook or anvil blade 30 is in pivotal relationship with upper cutting blade 40 as by pivot 12 extendable transversely through cheeks 16 of yoke 14 and through the lower hook or anvil blade and upper cutting blade.

Relative pivotal movement, between upper blade 40 and unitary lower handle 20 on the one hand, and lower blade 30 and upper handle 10 fixedly secured thereto on the other hand, is allowed through pivot 12 to the obvious end that the blades are actuated by handle manipulation.

A spring-actuated biasing means, preset so as to bias the cutting members to shear-opened position, is in the form of a leaf spring 50, concealed within the upper handle and secured at its outer extremity to the undersurface of top wall 10A of the upper handle by a leaf spring rivet 52, and configured at its inboard extremity with an upturned terminal portion 54 for bearing downwardly upon and riding along a radius 56 on the upper spine of upper blade 40.

As lower handle 20 is brought upwardly relative to upper handle 10 by the pressure of the operator's hand, terminal portion 54 rides along radius 56 of upper blade 40.

With the usual shear, that which passes for leaf spring rivet 52 is visible to any observer since it must, of necessity, extend through top wall 10A of upper handle 10, thus to impart an unsightly appearance to the handle and worse, possibly offer a roughened surface to irritate the hand of the user.

In this shear, the upper face of the spine or top wall 10A of upper handle 10 is provided with an outwardly facing central longitudinally-extending inset or recess 60 through the greater portion of its length, with leaf spring rivet 52 being extendable into and headed over in such recess.

A combination ornamental/information-bearing label 62 is provided and is secured as by adhesive or the like within the inset or recess.

Label 62 serves multiple purposes and advantages in that:

a. it imparts a pleasing appearance to the tool;

b. it conceals and covers the leaf spring rivet;

c. it carries information such as the manufacturer's or distributor's name, his trademark, tool model or number or the like; and d. it permits the application of such identifying information at the end of the production run, thereby achieving great economies in tool manufacture when the tools are being made to carry the labels of more than one distributor, the labels being interchangeable one with another so as to accommodate to the requirements of the respective distributors without the need for different tooling for otherwise impressing each different distributor's identifying indicia.

Label 62 may have any desired ornamentation thereon, such as a contrasting color or a woodgrain effect or the like, and it may carry any desired informational indicia.

Figure 5:
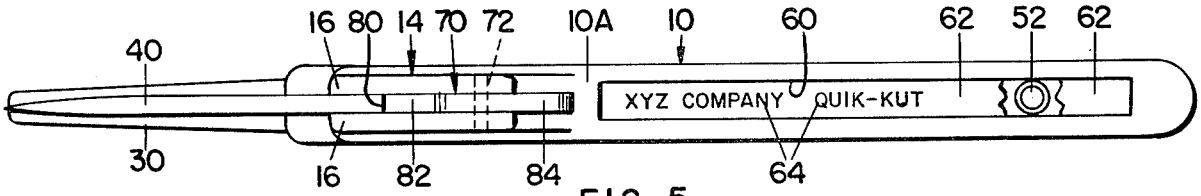
FIG. 5 is a view, in top plan, of the FIG. 1 shear.

In FIG. 5, label 62 is shown as carrying informational indicia 64 indicating the manufacturer's or distributor's name, trademark and any other desired data.

Figure 6:
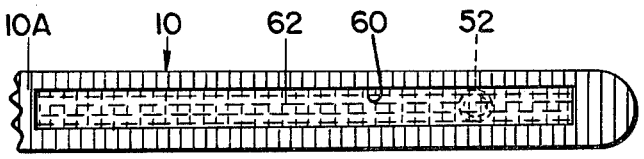
FIGS. 6 and 7 are fragmentary views, in top plan, of the upper shear handle, each incorporating ornamental inserts of different and contrasting color combinations.
Figure 7:
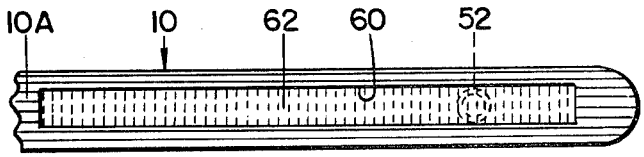

In FIGS. 6 and 7, label 62 is shown as being of one color, while upper handle 10 is shown as being of a compatible, contrasting color.

In FIG. 6, label 62 is shown as colored gold, while upper handle 10 is shown as colored red.

In FIG. 7, label 62 is shown as colored violet, while upper handle 10 is shown as colored blue.

Of course, identifying indicia 64 can also be applied to the colored labels of FIGS. 6 and 7.

The strip material and the adhesives proposed for attaching such strips to shears must be such as to meet certain conditions. The effects of water exposure on the adhesive in hot and cold weather, exposures to high and low temperatures, the toleration of surface contamination such as dust and the like, the resistance to peeling by acts of vandalism, and the resistance to dislodgement by impact are all considerations that have to be taken into account.

A latch 70 is disposed between cheeks 16 of yoke 14 and is pivoted to the cheeks as by a pivot pin 72 which passes laterally through a central opening 74 in the latch and is journalled at its opposite extremities in the cheeks.

One side face of latch 70 may be recessed as at 76 circumadjacent central opening 74 for receipt of a bearing washer 78 or the like therein.

Latch 70 is provided with a locking nose 80 at its inboard end and first and second finger engaging portions 82 and 84 respectively adjacent its inboard and outboard ends respectively.

In shear-locking position, locking nose 80 is engageable in a locking notch 86 in the spine of upper blade 40.

Locking nose 80 is brought into engagement with locking notch 86 by depressing first finger-engaging portion 82 to cause the latch to rotate in a counterclockwise direction relative to pivot pin 72, thereby locking blades 30 and 40 in closed position.

Locking and unlocking movement of latch 70 may be accomplished easily with one finger of one hand of the user.

Latch 70 is so located that it can be readily manipulated at all times, even when only one hand of the operator is available as when holding onto a ladder or grasping the material being cut, and even while the operator is holding the shear with his other hand. Such a provision allows the greatest degree of protection to both the shear and its user, since the shear is likely to be brought in its locked position to the situs where it is to be employed, then unlocked, manipulated, and then, returned to locked position before moving on.

We claim:

1. A shear comprising:

a cutting blade, an anvil blade, a yoke shaped upper handle having cheeks straddling the blades, a recess in the upper handle for the adhesive securement of an identifying label therein, a lower handle unitary with the cutting blade, interengaging means between handles and blades, spring means normally biasing the blades to opened position comprising a leaf spring concealed within the upper handle and secured at its outer extremity to the upper handle by a rivet extending into the recess and having an inboard extremity for bearing upon the cutting blade, a locking mechanism comprising a latch pivoted centrally of its length between the cheeks of the upper handle with the latch being pivotable between a cutting blade-anvil blade locked position of interengagement with the cutting blade and a cutting blade-anvil blade unlocked position of disengagement with the cutting blade, the latch having a locking nose engageable with a locking notch in the cutting blade and first and second finger engaging portions engageable by a finger of the user for pivotal movement of the latch and locking nose between blade-locked and blade-unlocked positions.

2. A shear according to claim 1, wherein the label bears identifying indicia in the nature of the manufacturer's or distributor's name, trademark and similar data.

3. A shear according to claim 1, wherein the label bears ornamentation.

4. A shear according to claim 1, wherein the label is colored.

5. A shear according to claim 1, wherein the label and upper handle are colored.

6. A shear according to claim 1, wherein the label and upper handle are of contrasting colors.

* * * * *